US010801740B2

(12) United States Patent
Yu et al.

(10) Patent No.: US 10,801,740 B2
(45) Date of Patent: Oct. 13, 2020

(54) EMBEDDED TYPE AIR CONDITIONER OUTDOOR UNIT AND AN AIR CONDITIONER

(71) Applicant: GREE ELECTRIC APPLIANCES, INC. OF ZHUHAI, Zhuhai (CN)

(72) Inventors: Kai Yu, Zhuhai (CN); Handong Xue, Zhuhai (CN); Youfu Xie, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 106 days.

(21) Appl. No.: 16/119,568

(22) Filed: Aug. 31, 2018

(65) Prior Publication Data

US 2020/0072477 A1 Mar. 5, 2020

(51) Int. Cl.
*F24F 1/10* (2011.01)

(52) U.S. Cl.
CPC ..... *F24F 1/10* (2013.01)

(58) Field of Classification Search
CPC ..... F24F 1/10
See application file for complete search history.

(56) References Cited

U.S. PATENT DOCUMENTS 6,092,377 A * 7/2000 Tso ..... F24F 1/10 165/122
10,260,780 B2 * 4/2019 Li ..... F25B 1/06
10,605,466 B2 * 3/2020 Okuda ..... F25B 43/003
10,670,344 B2 * 6/2020 Ito ..... F28F 1/22
2001/0037874 A1 * 11/2001 Hata ..... F24F 1/0022 165/53
2008/0148749 A1 * 6/2008 Ishida ..... F24F 11/62 62/157
2009/0044554 A1 * 2/2009 Takeichi ..... F24F 1/26 62/259.1
2014/0298844 A1 * 10/2014 Luo ..... F24F 1/36 62/275
2016/0076779 A1 * 3/2016 Lee ..... F24F 1/36 62/508

(Continued)

FOREIGN PATENT DOCUMENTS

FR 3048763 A1 * 9/2017 ..... F24F 1/40
KR 100573067 B1 * 4/2006

OTHER PUBLICATIONS

FR 3048763 A1 mt (Year: 2017).*
KR 100573067 B1 mt (Year: 2006).*

*Primary Examiner* — Gordon A Jones
(74) *Attorney, Agent, or Firm* — Oblon, McClelland, Maier & Neustadt, L.L.P.

(57) ABSTRACT

The present disclosure relates to an embedded type air conditioner outdoor unit and an air conditioner, wherein the embedded type air conditioner outdoor unit is configured to be embedded within a wall of a building, and the embedded type air conditioner outdoor unit comprises a heat exchanger, which includes a first inlet for introducing a refrigerant and a second inlet for introducing a heat exchange medium to perform heat exchange with the refrigerant. By applying the technical solution of the present application, in which the heat exchange medium is used to perform heat exchange with the refrigerant, the embedded type air conditioner outdoor unit of the present embodiment may be used without a fan system, so that the embedded type air conditioner outdoor unit has reduced vibration and noise.

7 Claims, 2 Drawing Sheets

(56) References Cited

U.S. PATENT DOCUMENTS

| | | | | |
|---|---|---|---|---|
| 2017/0328583 | A1* | 11/2017 | Okuda | F25B 41/003 |
| 2018/0372344 | A1* | 12/2018 | Abukawa | F24F 1/10 |
| 2019/0154279 | A1* | 5/2019 | Koike | F24F 1/56 |
| 2019/0195516 | A1* | 6/2019 | Xue | F24F 1/52 |
| 2019/0195517 | A1* | 6/2019 | Xue | F24F 1/46 |
| 2020/0132314 | A1* | 4/2020 | Kojima | F24F 3/065 |

* cited by examiner

EMBEDDED TYPE AIR CONDITIONER OUTDOOR UNIT AND AN AIR CONDITIONER

FIELD OF THE INVENTION

The present disclosure relates to the field of a refrigeration device, and specifically, relates to an embedded type air conditioner outdoor unit and an air conditioner.

BACKGROUND OF THE INVENTION

At present, the outdoor unit of a household VRF (Variable refrigerant Volume) is mostly installed at such places as a preset air-conditioner installation location on an exterior wall or a roof. When the exterior wall is absent with an air-conditioner installation location and the preset air-conditioner installation location is far away from the roof, it is very hard to install an outdoor unit. In particular for the houses in North American area, due to the safety requirements, the air conditioner outdoor unit is not allowed to be suspended outside the wall. When the air conditioner outdoor unit is embedded in the wall of a building, it is easy to transmit vibration and noise into the indoor, so that the user's feeling is degraded.

SUMMARY OF THE INVENTION

The present disclosure aims to provide an embedded type air conditioner outdoor unit and an air conditioner, to improve the problem of much noise of an air conditioner present in the prior art.

According to one aspect of an embodiment of the present disclosure, the present disclosure provides an embedded type air conditioner outdoor unit configured to be embedded within a wall of a building the embedded type air conditioner outdoor unit comprises a heat exchanger, which comprises a first inlet for introducing a refrigerant and a second inlet for introducing a heat exchange medium to perform heat exchange with the refrigerant.

Alternatively, the heat exchanger comprises a plate heat exchanger.

Alternatively, the embedded type air conditioner outdoor unit further comprises a housing, within which the heat exchanger is positioned, wherein the housing is enclosed.

Alternatively, the heat exchanger is disposed at a position adjacent to a first side wall of the housing, and the embedded type air conditioner outdoor unit further comprises a compressor provided on a side of the heat exchanger facing opposite to the first side wall.

Alternatively, the embedded type air conditioner outdoor unit further comprises a gas-liquid separator provided on a side of the heat exchanger facing opposite to the first side wall, wherein the gas-liquid separator and the compressor are arranged side by side in the first direction parallel to the first side wall.

Alternatively, the embedded type air conditioner outdoor unit further comprises an electrical box disposed within the housing, the electrical box is located at first end of the housing in the first direction.

Alternatively, the embedded type air conditioner outdoor unit further comprises a four-way valve (9), which is located at a second end of the housing in the first direction.

Alternatively, the embedded type air conditioner outdoor unit further comprises: a refrigerant inlet communicating with the first inlet of the heat exchanger and located at a second end of the housing in the first direction; or a medium inlet communicating with the second inlet of the heat exchanger and located at a second end of the housing in the first direction.

According to another aspect of the present application, there is also provided an air conditioner, which comprises the aforementioned embedded type air conditioner.

Alternatively, the air conditioner further comprises a plurality of indoor units, which communicate with the embedded type air conditioner outdoor unit.

By applying the technical solution of the present application, in which the heat exchange medium is used to perform heat exchange with the refrigerant, the embedded type air conditioner outdoor unit of the present embodiment may be used without a fan system, so that the embedded type air conditioner outdoor unit has reduced vibration and noise.

BRIEF DESCRIPTION OF THE ACCOMPANYING DRAWINGS

The aforementioned as well as other objects, features and advantages of the present disclosure will be more clear, by means of the following descriptions of the embodiments of the present disclosure with reference to the drawings, in which drawings.

Figure 1:
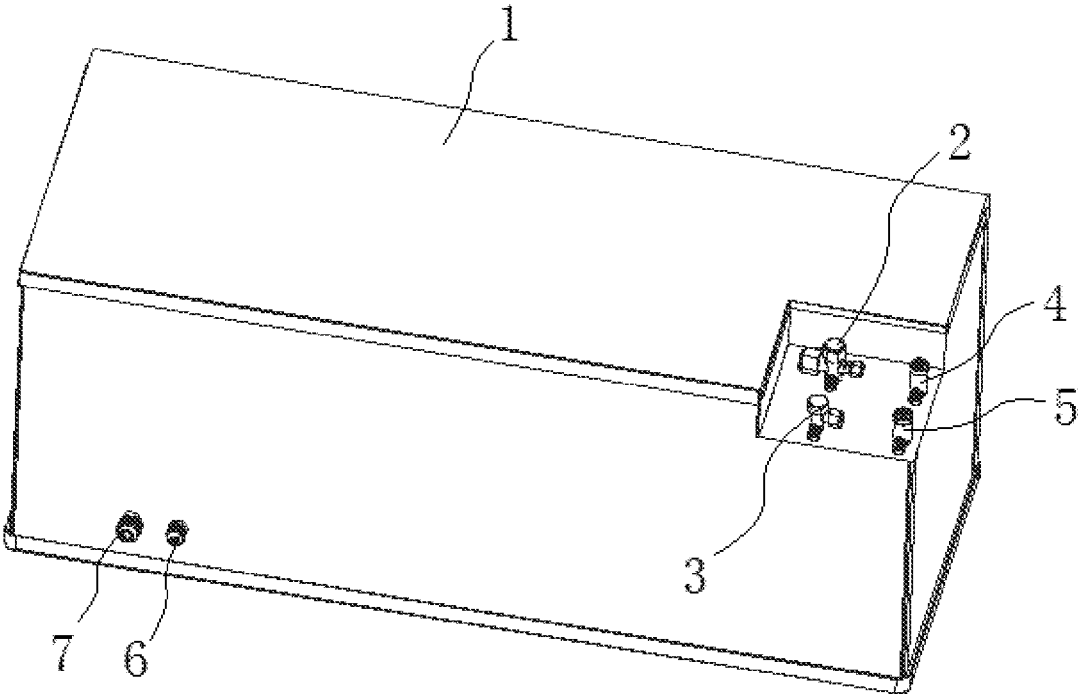
FIG. 1 shows a perspective schematic structural view of the embedded type air conditioner outdoor unit according to an embodiment of the present disclosure.

In the drawings: 1. housing; 2. refrigerant inlet; 3. refrigerant outlet; 4. media inlet; 5. media outlet; 6. communication interface; 7. power interface; 8. heat exchanger; 9. four-way valve; 10. compressor; 11. gas-liquid separator; 12, electrical box; 13. wall; 14. Window.

DETAILED DESCRIPTION OF THE PREFERRED EMBODIMENTS

The present disclosure is described as follows on the basis of the embodiments, but the present disclosure is not only limited to such embodiments. Several specific detailed portions are described in detail in the following detailed descriptions of the present disclosure. For a person skilled in the art, the present disclosure may also be fully understood without descriptions of such detailed portions. In order to avoid confusion of the essence of the present disclosure, detailed narrations are not made to the commonly known methods, processes, flow procedures, and elements.

Figure 2:
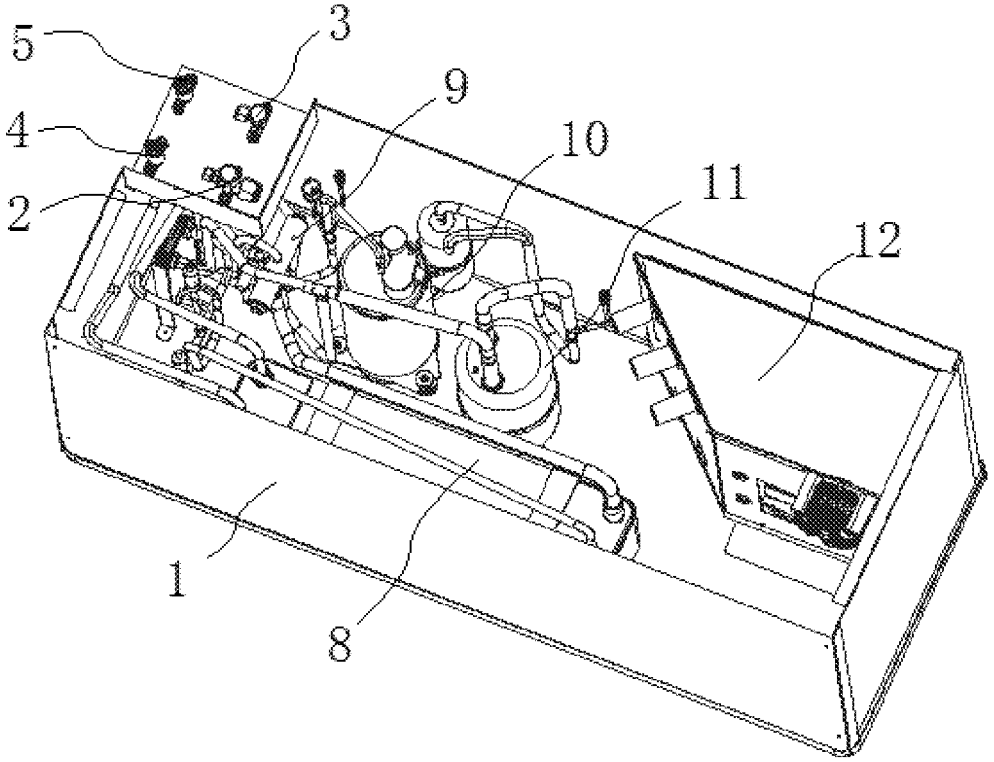
FIG. 2 shows a schematic view of the internal structure of the embedded type air conditioner outdoor unit according to an embodiment of the present disclosure.
Figure 3:
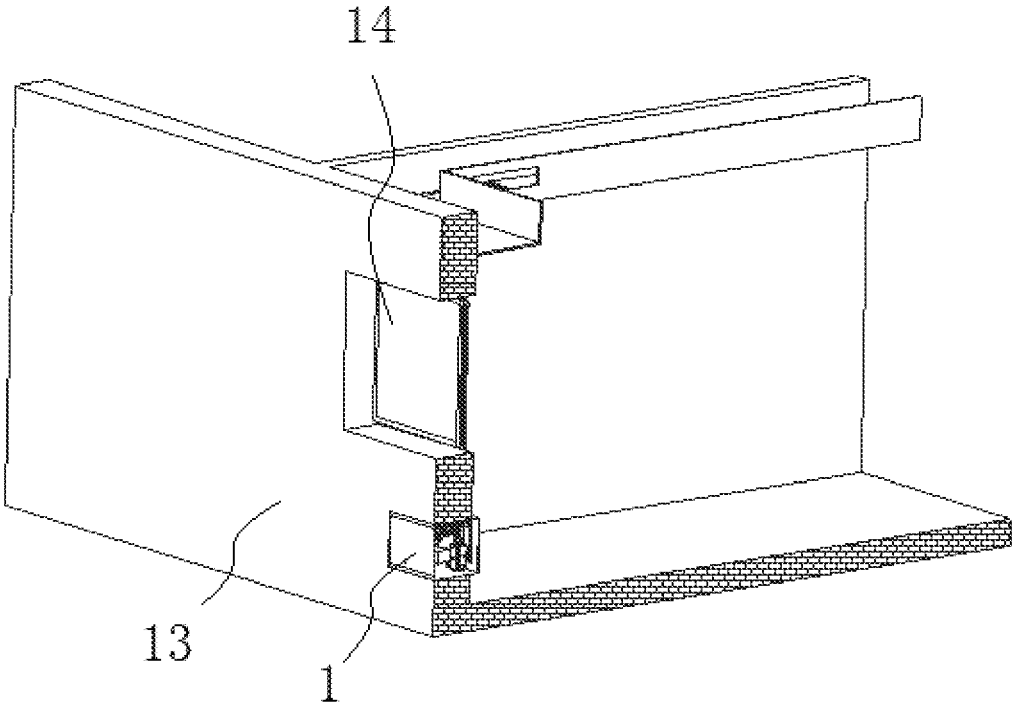
FIG. 3 shows a schematic view of an installation structure of the embedded type air conditioner outdoor unit according to an embodiment of the present disclosure.
Figure 4:
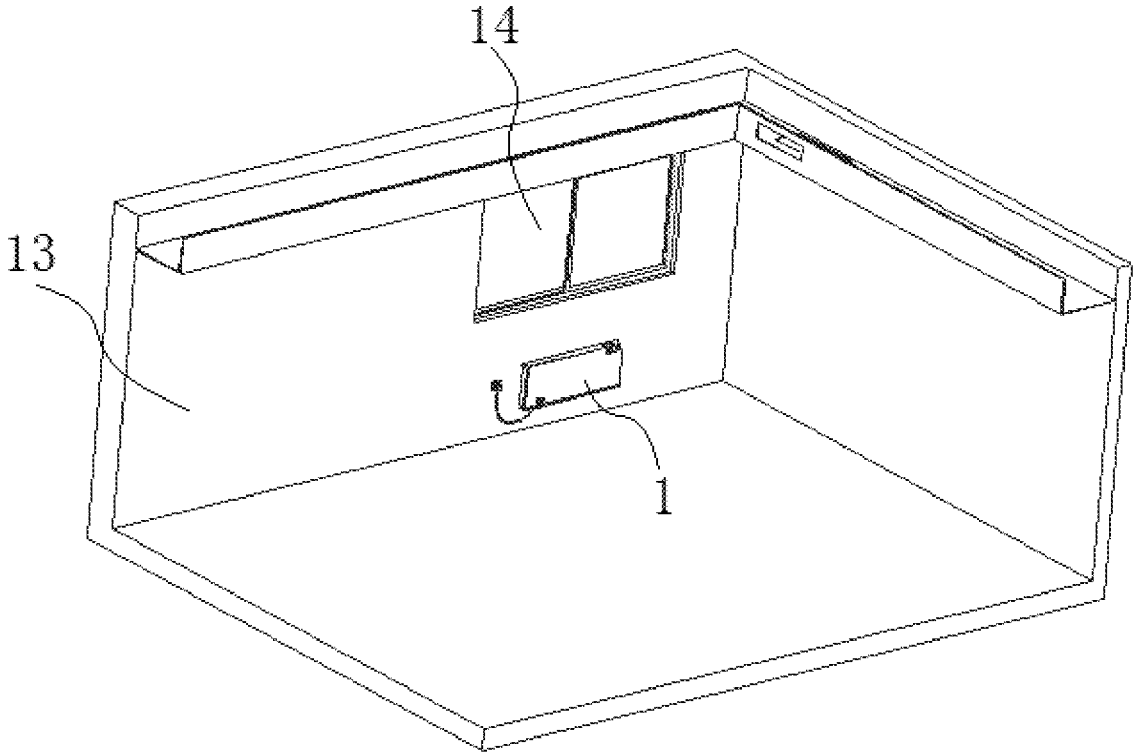
FIG. 4 shows a schematic view of an installation structure of the embedded type air conditioner outdoor unit according to an embodiment of the present disclosure from another perspective.

FIG. 1 shows a perspective schematic structural view of the embedded type air conditioner outdoor unit according to the present embodiment; FIG. 2 shows a schematic view of the internal structure of the embedded type air conditioner outdoor unit according to the present embodiment; FIG. 3 shows a schematic view of an installation structure of the embedded type air conditioner outdoor unit according to the present embodiment; and FIG. 4 shows a schematic view of an installation structure of the embedded type air conditioner outdoor unit according to the present embodiment from another perspective.

In combination with the illustrations of FIGS. 1 to 4, the embedded type air conditioner outdoor unit of the present embodiment is embedded within a wall 13 of a building. The wall 13 of a building is preset with a square hole for installing the embedded type air conditioner outdoor unit, within which the embedded type air conditioner outdoor unit is mounted. The embedded type air conditioner outdoor unit does not protrude from the exterior wall of a building.

Relative to the technical solution that the air conditioner outdoor unit is suspended from the outer wall of the building in the related art, the embedded type air conditioner outdoor unit can prevent accidental damage and accidental loss caused by accidental fall-off.

Alternatively, the embedded type air conditioner outdoor unit is mounted below a window 14 and above the indoor floor.

The embedded type air conditioner outdoor unit of the present embodiment comprises a heat exchanger 8 including a first heat exchange portion for circulating a refrigerant and a second heat exchange portion for circulating a heat exchange medium in heat exchange with the refrigerant.

The heat exchanger 8 includes a plate heat exchanger including a plurality of sheet-like members stacked along a length direction of the plate heat exchanger, in which a flow passage formed between two adjacent sheet-like members includes a first flow passage for circulating a refrigerant and a second flow passage for flowing a heat exchange medium. The first flow passage and the second flow passage are alternately arranged along a length direction of the plate heat exchanger. The first flow passage is on one side of the sheet-like member, while the second flow passage is on the other side thereof.

The heat exchanger 8 includes a first inlet for introducing a refrigerant to perform heat exchange, a second inlet for introducing a heat exchange medium in heat exchange with the refrigerant, a first outlet for outputting the refrigerant after heat exchange, and a second outlet for outputting the heat exchange medium after heat exchange.

The first inlet, the first flow passage and the first outlet communicate sequentially, and the refrigerant compressed by the compressor 10 sequentially flows through the first inlet, the first flow passage and the first outlet.

The second inlet, the second flow passage and the second outlet communicate sequentially, and the heat exchange medium sequentially flows through the second inlet, the second flow passage and the second outlet, and performs heat exchange with the refrigerant in the first flow passage.

As shown in FIGS. 1 and 2, the embedded type air conditioner outdoor unit further comprises a refrigerant inlet 2 for introducing a refrigerant to perform heat exchange and a refrigerant outlet 3 for outputting a refrigerant after heat exchange. The refrigerant inlet 2 is in communication with the first inlet of the heat exchanger 8, and the first outlet of the heat exchanger 8 is in communication with the refrigerant outlet 3.

The embedded type air conditioner outdoor unit further comprises a medium inlet 4 for introducing a heat exchange medium and a medium outlet 5 for outputting a heat exchange medium. The medium inlet 4 is in communication with the second inlet of the heat exchanger 8, and the second outlet of the heat exchanger 8 is in communication with the medium outlet 5.

The refrigerant introduced by the refrigerant inlet 2 sequentially flows through a plurality of first flow passages arranged along a length direction of the plate heat exchanger, and the heat exchange medium introduced by the medium inlet 4 sequentially flows through the second flow passages arranged in order along a length direction of the plate heat exchanger. The refrigerant in the first flow passage performs heat exchange with the refrigerant in the second flow passage. The refrigerant after heat exchange flows out via the refrigerant outlet 3, and the heat exchange medium after heat exchange flows out via the medium outlet 5.

By using the heat exchange medium to perform heat exchange with the refrigerant, the embedded type air conditioner outdoor unit of the present embodiment may be used without a fan system, so that the embedded type air conditioner outdoor unit has reduced vibration.

The embedded heat exchanger further comprises a housing 1, within in which the heat exchanger 8 is disposed. The housing 1 is enclosed, and the vibration of the embedded type air conditioner outdoor unit is further reduced.

Referring to FIG. 2, the heat exchanger 8 is disposed at a position adjacent to the first side wall of the housing 1, and alternatively, the heat exchanger 8 is parallel to the aforementioned first side wall. The first side wall is an outer side wall of the housing 1 adjacent to the outdoor. The embedded type air conditioner outdoor unit further comprises a compressor 10 provided on a side of the heat exchanger 8 facing opposite to the first side wall. Alternatively, the heat exchanger 8 is parallel to the first side wall of the housing 1. It is also preferred that, the heat exchanger 8 is attached against the first side wall.

The embedded type air conditioner outdoor unit further comprises a gas-liquid separator 11 provided on a side of the heat exchanger 8 facing opposite to the first side wall, and the gas-liquid separator 11 is disposed side by side with the compressor 10.

The plate heat exchanger stands beside the first side wall of the housing 1 parallel to the wall 13 of a building, and the gas-liquid separator 11 and the compressor 10 are arranged side by side on one side of the heat exchanger 8 facing opposite to the first side wall, so as to make a compact structure of the embedded type air conditioner outdoor unit. The gas-liquid separator 11 and the compressor 10 are arranged in the first direction, the first direction is parallel to the first side wall.

The embedded type air conditioner outdoor unit further comprises an electrical box 12 provided within the housing 1, and the electrical box 12 is located at the first end of the housing in the first direction, to make the embedded type air conditioner outdoor unit more compact.

The embedded type air conditioner outdoor unit further comprises a four-way valve 9 including an inlet, an outlet, a first working port and a second working port. The inlet of the four-way valve 9 is in communication with an exhaust port of the compressor 10, the outlet of the four-way valve 9 is in communication with a suction port of the compressor 10, and the first working port of the four-way valve 9 is in communication with the heat exchanger 8. The second working port of the four-way valve 9 is used for communicating with the indoor unit of the air conditioner. The four-way valve 9 is located at a second end of the housing in the first direction.

A power port 7 and a communication interface 6 are further provided on the second side wall of the housing 1 facing towards the indoor side.

The electrical box 12 is located at the first end of the housing in the first direction, and the four-way valve 9 is located at the second end of the housing in the first direction. The refrigerant inlet 2, the refrigerant outlet 3, the medium inlet 4, and the medium outlet 5 are all located at the second end of the housing in the first direction.

In this embodiment, the compressor 10 and the heat exchanger 8 are arranged along a thickness direction of the wall 13 of a building, the electrical box 12 is disposed at the first end of the heat exchanger 8, and the four-way valve 9 and the pipeline connected to the four-way valve 9 is disposed at the second end of the heat exchanger 8, so that the embedded type outdoor unit has a small size in a thickness direction of the wall 13.

According to another aspect of the present application, there is also provided an air conditioner, which comprises the above-described embedded type air conditioner outdoor unit.

The air conditioner comprises a plurality of indoor units, which communicate with the aforementioned embedded type air conditioner outdoor unit.

The foregoing is intended only as a preferred embodiment of the present disclosure, but is not used for limiting the present disclosure, and for a person skilled in the art, the present disclosure may have various modifications and variations. Any amendment, equivalent replacement, improvement, and the like within the spirit and principles of the present disclosure should all be contained within the protection scope of the present disclosure.

The invention claimed is:

1. An embedded type air conditioner outdoor unit, configured to be embedded within a wall of a building, the embedded type air conditioner outdoor unit comprising:

a heat exchanger, the heat exchanger comprises a first inlet for introducing a refrigerant and a second inlet for introducing a heat exchange medium for exchanging heat with the refrigerant;

a housing within which the heat exchanger is positioned, wherein the housing is enclosed and the heat exchanger is adjacent to a first side wall of the housing;

a compressor provided on a side of the heat exchanger opposite to the first side wall;

a gas-liquid separator provided on the side of the heat exchanger opposite to the first side wall, wherein the gas-liquid separator and the compressor are arranged side by side in a first direction parallel to the first side wall;

an electrical box disposed within the housing, the electrical box is located at a first end of the housing in the first direction; and a four-way valve disposed within the housing at a second end of the housing in the first direction, wherein the compressor and the gas-liquid separator are positioned within the housing between the electrical box and the four-way valve.

2. The embedded type air conditioner outdoor unit according to claim 1, wherein the heat exchanger comprises a plate heat exchanger body.

3. The embedded type air conditioner outdoor unit according to claim 1, further comprising:

a refrigerant inlet communicating with the first inlet of the heat exchanger and located at the second end of the housing in the first direction; or a medium inlet communicating with the second inlet of the heat exchanger and located at the second end of the housing in the first direction.

4. An air conditioner, comprising:

an embedded type air conditioner outdoor unit that is configured to be embedded within a wall of a building, the embedded type air conditioner outdoor unit comprising:

a heat exchanger, the heat exchanger comprises a first inlet for introducing a refrigerant and a second inlet for introducing a heat exchange medium for exchanging heat with the refrigerant;

a housing within which the heat exchanger is positioned, wherein the housing is enclosed and the heat exchanger is adjacent to a first side wall of the housing;

a compressor provided on a side of the heat exchanger opposite to the first side wall;

a gas-liquid separator provided on the side of the heat exchanger opposite to the first side wall, wherein the gas-liquid separator and the compressor are arranged side by side in a first direction parallel to the first side wall;

an electrical box disposed within the housing, the electrical box is located at a first end of the housing in the first direction; and a four-way valve disposed within the housing at a second end of the housing in the first direction, wherein the compressor and the gas-liquid separator are positioned within the housing between the electrical box and the four-way valve.

5. The air conditioner according to claim 4, further comprising a plurality of indoor units, which communicate with the embedded type air conditioner outdoor unit.

6. The embedded type air conditioner outdoor unit according to claim 1, wherein the embedded type air conditioner outdoor unit is embedded within a wall of a building.

7. The embedded type air conditioner outdoor unit according to claim 1, wherein the heat exchanger is positioned closer to the first side wall of the housing than the compressor is, and the compressor is positioned closer to a second wall of the housing than the heat exchanger is, the second side wall of the housing being opposite to the first side wall.

* * * * *